US005482168A

United States Patent [19]

Welch et al.

[11] Patent Number: 5,482,168

[45] Date of Patent: Jan. 9, 1996

[54] MODULAR WALL-MOUNTED STORAGE SYSTEM

[75] Inventors: Robert J. Welch, Dallas; Michael A. Ward, Wilkes-Barre, both of Pa.

[73] Assignee: Metro Industries, Inc., Reno, Nev.

[21] Appl. No.: 111,448

[22] Filed: Aug. 25, 1993

[51] Int. Cl.[6] ..... A47F 5/00

[52] U.S. Cl. ..... 211/106; 211/181

[58] Field of Search ..... 211/106, 103, 211/87, 181; 248/243, 249

[56] References Cited

U.S. PATENT DOCUMENTS

| | | | |
|---|---|---|---|
| 2,428,073 | 9/1947 | Handel | 211/87 |
| 2,665,869 | 1/1954 | Samuels | 211/87 X |
| 3,172,540 | 3/1965 | Berge | 211/87 |
| 4,542,832 | 9/1985 | Minick et al. | 211/106 |
| 4,884,702 | 12/1989 | Rekow | 211/106 X |

FOREIGN PATENT DOCUMENTS

| | | | |
|---|---|---|---|
| 1230856 | 5/1971 | United Kingdom | 211/106 |

*Primary Examiner*—Ramon O. Ramirez
*Assistant Examiner*—Sarah L. Purol
*Attorney, Agent, or Firm*—Fitzpatrick, Cella, Harper & Scinto

[57] ABSTRACT

A modular wall-mounted storage system includes at least one shelf, at least one horizontal bar, at least one pair of shelf brackets, and at least one pair of vertical uprights. Each shelf bracket includes structure for supporting a shelf and structure for engaging at least one horizontal bar. Each vertical upright includes a slotted support structure for receiving and supporting at least one horizontal bar at a variety of vertical and horizontal locations thereof, wherein each horizontal bar may be received and supported on a pair of vertical uprights at a variety of vertical and horizontal locations relative to each vertical upright.

22 Claims, 5 Drawing Sheets

MODULAR WALL-MOUNTED STORAGE SYSTEM

BACKGROUND OF THE INVENTION

1. Field of the Invention

The present invention relates generally to storage systems, and more particularly to an improved modular wall-mounted shelving system. The shelving system of the present invention incorporates a plurality of vertically mounted slotted uprights and horizontal bars that securely yet selectively support a variety of shelves in a variety of locations relative to the slotted vertical uprights. The system also may include an optional grid for selectively supporting various shelf-like containers or brackets.

2. Description of the Prior Art

Modular wall-mounted storage systems are known. Generally, such systems include a plurality of vertically mounted uprights, a plurality of shelves, and a plurality of shelf brackets or supports, for supporting the shelves on the uprights.

In one such system, the shelf brackets are designed to engage the shelves at fixed horizontal locations such as the ends of the shelves. The brackets also engage cooperating structures of the vertical uprights, at a variety of vertical locations, to securely support the shelves at a variety of vertical locations. Although these systems have utility in many applications, they suffer from a number of drawbacks. In particular, it is often difficult or impossible to align the vertical uprights with existing wall studs or comparable structure when the system is located in a desired location. Accordingly, when such systems are installed, the installer generally has three options: 1) to mount the modular system in a less than ideal location; 2) to mount at least one of the vertical uprights to the wall surface rather than to an existing stud; or 3) to mount an intermediate surface, such as plywood, to the wall and to mount the vertical uprights to the intermediate surface. Option 1 may be impractical, aesthetically undesirable, and may not be possible due to the geometry of the available wall space. Option 2 may be unacceptable due to weight or loading limitations of the shelf system. Option 3 is costly, aesthetically undesirable, and may not be possible due to the geometry of the storage location. For example, the depth of a closet may be insufficient to accommodate the combined depth of the shelf and the intermediate surface.

In another known system, similar to that described as option 3 above, horizontal cross-framing is provided between the vertical uprights of the modular shelving system. In this manner, the modular system may be mounted to the wall at the studs or comparable structure via the cross-framing. However, in addition to the above-mentioned drawbacks of option 3, such a system suffers a drawback in that it may not be as stably supported as systems in which the vertical uprights are directly mounted to the supporting studs or comparable structure.

In yet another known shelving system, the shelves are movable relative to the shelf brackets. In other words, each shelf bracket may engage a shelf at a variety of horizontal locations. Although these systems are advantageous in that the vertical uprights may be mounted directly to the wall studs or comparable support structures, and the shelves may be supported at various locations relative to the mounted uprights, such a system suffers a drawback in that its shelves generally are not stably supported, for example, rigidly engaged at their ends. Alternatively, such a system generally requires a complicated or costly shelf or bracket design to securely engage the brackets to a shelf at a variety of horizontal locations.

SUMMARY OF THE INVENTION

It is therefore an object of the present invention to provide an improved modular wall-mounted storage system including a plurality of vertical uprights that may be rigidly secured to existing wall studs or the like.

It is another object of the present invention to provide an improved modular wall-mounted storage system that permits a plurality of shelves or other structures to be stably supported at a variety of horizontal and vertical locations relative to a plurality of vertical uprights.

It is still another object of the present invention to provide an improved modular wall-mounted storage system that permits easy insertion and removal of a variety of shelves at a variety of horizontal and vertical locations relative to a plurality of vertical uprights.

These objects and further advantages are achieved by the present-invention, which in a preferred embodiment is an improved modular wall-mounted shelving system including at least one pair of slotted vertical uprights, at least one horizontal bar, at least one shelf, and at least one pair of shelf brackets. In one aspect, each vertical upright includes a slotted support structure for receiving and supporting each horizontal bar at a variety of vertical and horizontal locations relative to the vertical upright. Each shelf bracket includes structure for engaging at least one horizontal bar at a variety of horizontal locations thereof. Therefore, the system provides structure for securely supporting a shelf at a variety of vertical and horizontal locations relative to each of the vertical uprights.

In another aspect, the system may include at least one pair of horizontal bars and at least one pair of shelf brackets, and each vertical upright may include a slotted support structure for receiving and supporting each of a pair of horizontal bars at a variety of vertical and horizontal locations relative to the vertical upright.

In yet another aspect, the system further may include a vertical wire-like grid having at least one horizontal grid rail. Each vertical upright may further include a slotted support structure for receiving and supporting a horizontal grid rail, wherein the grid may be supported at a variety of vertical and horizontal locations relative to each of the vertical uprights.

In a further aspect, the grid may include at least a pair of horizontal grid rails, and each vertical upright may further include a slotted support structure for receiving and supporting each of a pair of horizontal grid rails.

These and other objects, aspects, and features of the present inventions will be understood from the detailed description of the preferred embodiment provided below taken in conjunction with the accompanying drawings.

DETAILED DESCRIPTION OF THE PREFERRED EMBODIMENTS

Figure 1:
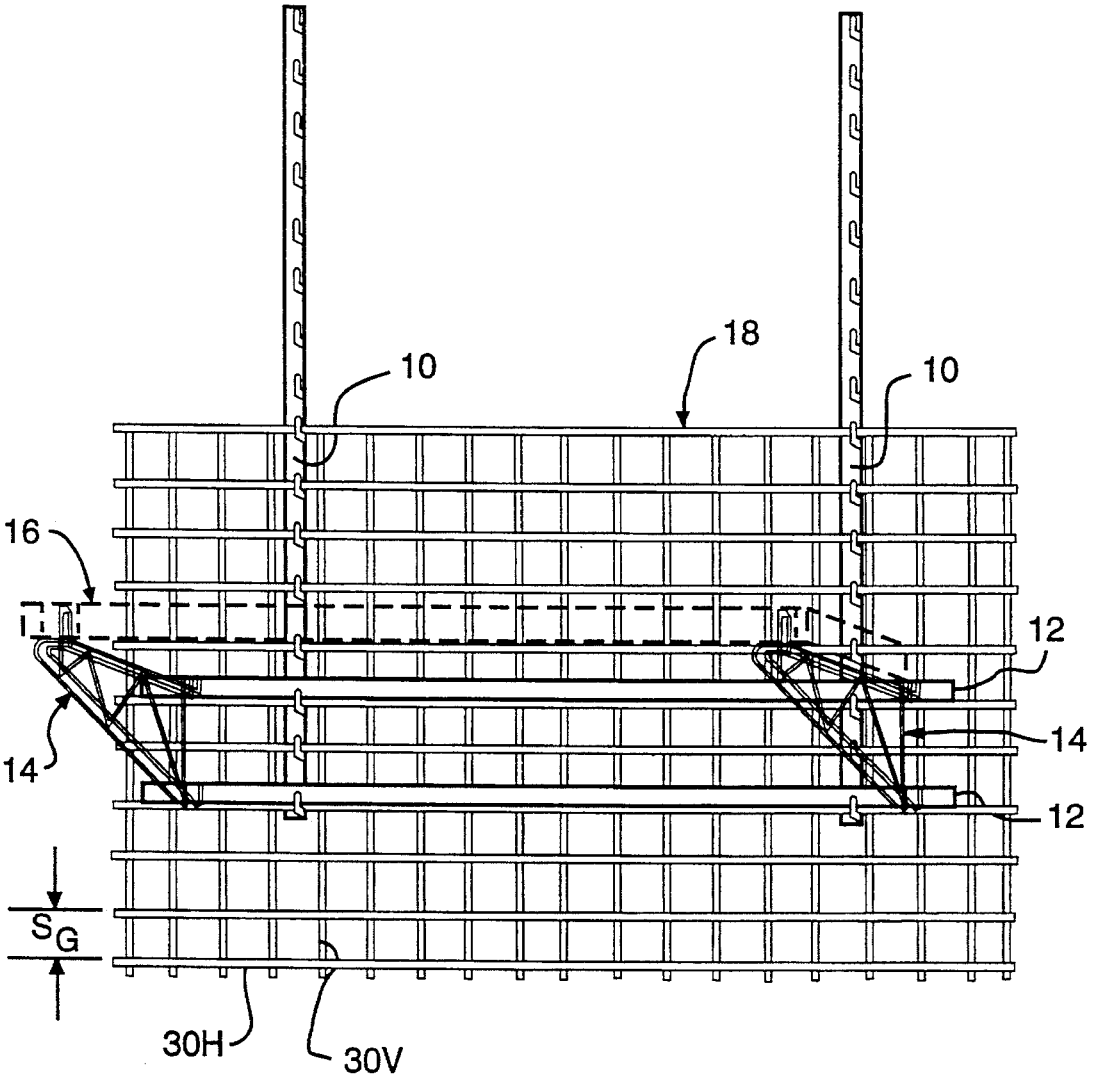
FIG. 1 is a front perspective view of an embodiment of a modular wall-mounted storage system according to the present invention.
Figure 2:
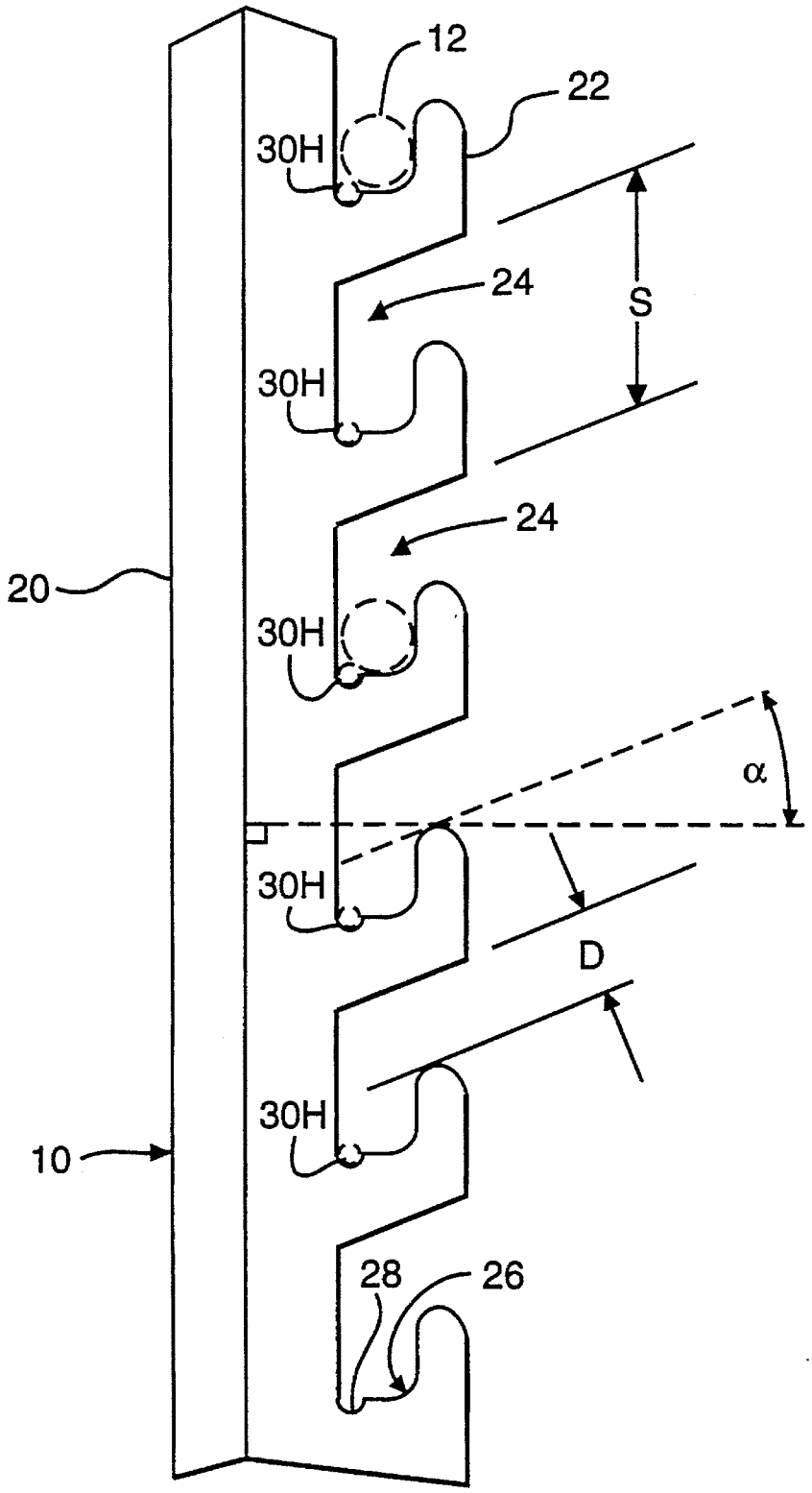
FIG. 2 is side perspective view of a vertical upright of the storage system of FIG. 1, illustrating a slotted structure for receiving and supporting at least a pair of horizontal bars of the storage system of FIG. 1, and for receiving and supporting at least a pair of grid rails of a vertical wire-like grid of the storage system of FIG. 1.
Figure 3:
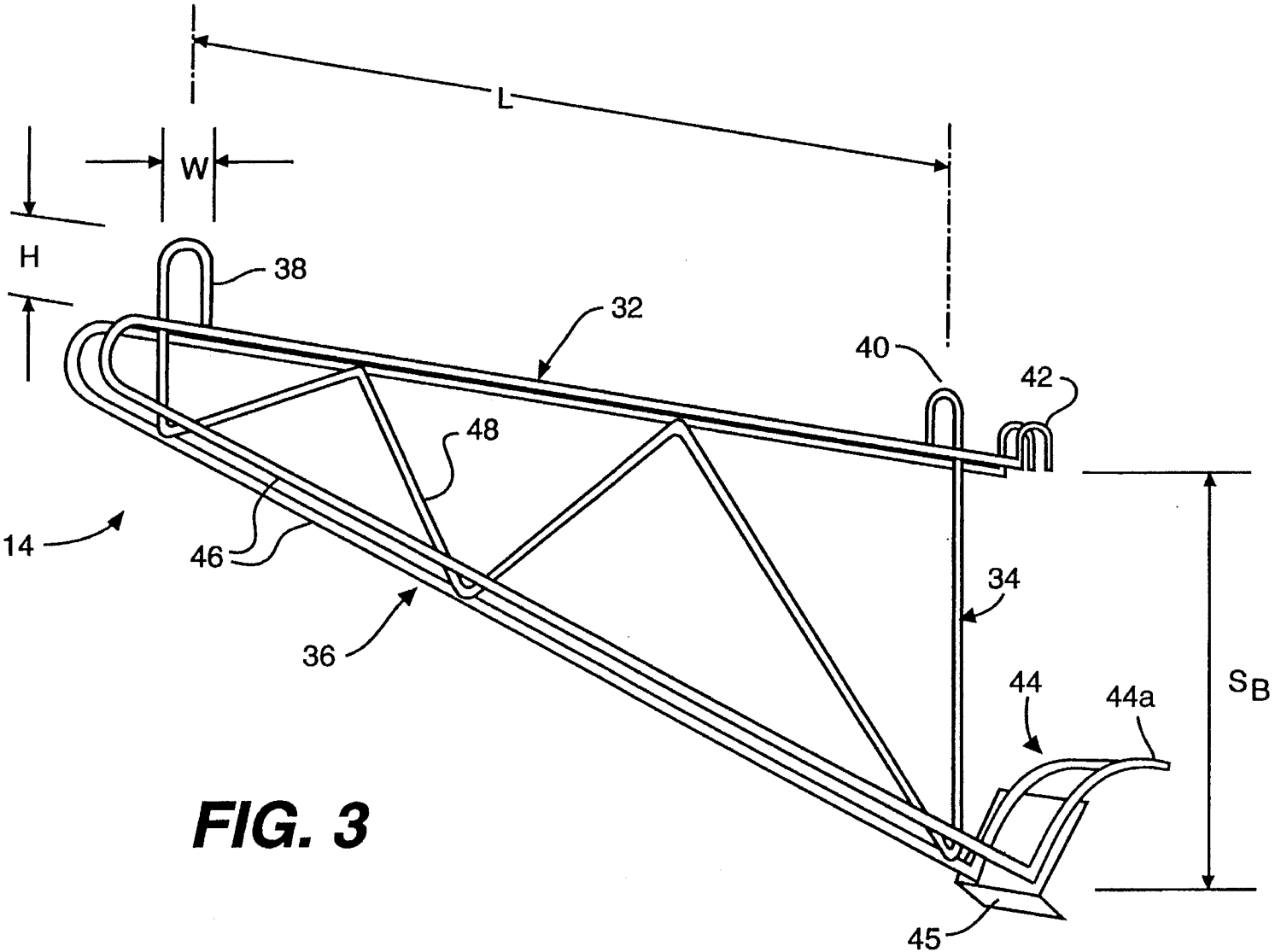
FIG. 3 is a side perspective view of a shelf bracket of the storage system of FIG. 1, illustrating structure for engaging each of the pair of horizontal bars, and structure for engaging and supporting a shelf.

Referring now to FIGS. 1 to 3, a preferred embodiment of a modular wall-mounted storage system of the present invention is illustrated. As best shown in FIG. 1, the storage system generally includes a pair of vertical uprights 10, a pair of horizontal bars 12, a pair of shelf brackets 14, and a shelf 16 (shown in phantom). The system also includes an optional wire-like grid 18.

As discussed in greater detail below, each of the pair of vertical uprights 10 is mounted to an existing stud of a wall, or other comparable structure (not shown), by known means such as screws. Each upright includes a slotted structure for receiving and supporting each of the pair of horizontal bars 12. Each of the pair of shelf brackets 14 includes structure for engaging each of the pair of horizontal bars 12, and structure for engaging and supporting shelf 16. The vertical uprights 10 also include an optional slotted structure for receiving and supporting the grid 18.

In the present application, the term "slot" or "slotted" refers to any structure having an opening or clearance through which a horizontal bar 12 may be inserted and supported. Thus, these terms include structures such as holes, slats, slits, projections and the like. Those skilled in the art readily will appreciate numerous equivalent structures for performing this function.

Thus, each vertical upright 10 may have any of numerous configurations. For example, as shown in FIG. 2, each vertical upright 10 generally includes a base portion 20, through which it is mounted to a wall stud or the like, and a slotted support portion or web 22 extending away from base portion 20 at about 90 degrees, for receiving and supporting a variety of shelves or shelf-like structures. Thus, in the form shown in FIGS. 1 and 2, each vertical upright 10 is an L-shaped angle, wherein one leg of the L forms the base portion 20 and the other leg of the L forms the slotted support portion or web 22. In another embodiment (not shown), each vertical upright 10 may have a T-shaped configuration. As another embodiment (not shown), each upright 10 may have a U-shaped configuration comprising a base portion and two parallel slotted support portions or webs spaced sufficiently to support a horizontal bar. In still another alternative, the vertical upright 10 may have a flat configuration, wherein the base portion 20 forms an extension that may be inserted between two adjacent wall panels. The vertical upright 10 may be formed of any convention material suitable for mounting and supporting shelving, such as a plastic or a metal, for example, steel, aluminum, brass, or the like. Those skilled in the art readily will appreciate numerous equivalent structures and alternative compositions.

The slotted support structure 22 of each vertical upright 10 includes a plurality of slots 24 formed periodically along the vertical height of the upright 10. In the embodiment of FIGS. 1 to 3, each slot 24 is open, the width D of each slot 24 is about 1 1/32 inches, and the center-to-center spacing S of slots 24 is about 3 inches. Of course, the width D of each slot 24 and the spacing S between adjacent slots 24 will vary depending on a number of factors, including the size and configuration of the horizontal bars 12, the composition of the vertical upright 10, and the storage application.

In the present embodiment, as best shown in FIG. 2, each slot 24 generally is formed at an angle $\alpha$, and includes a large trough 26 for receiving a horizontal bar 12. Each slot 24 optionally may also include a small second trough 28 for receiving a horizontal grid rail 30H of the grid 18. In this manner, slots 24 thus define hook-like configurations. The angle $\alpha$ is selected to provide easy access for insertion and removal of a horizontal bar 12 or a horizontal rail 30H, while providing a support structure for securely and stably supporting these shelving members. In the embodiment of FIGS. 1 to 3, angle $\alpha$ preferably is in the range of about 20 to 40° degrees, and most preferably is about 30 degrees.

Each large trough 26 has a geometrical configuration selected for receiving and supporting a respective horizontal bar 12 having a cross-section of a corresponding geometrical configuration. In the embodiment of FIGS. 1 to 3, each large trough 26 has a generally circular or crescent configuration, for receiving and supporting a corresponding tubular or cylindrical horizontal bar 12. Also, each large trough 26 is formed at a base portion of a respective slot 24. In this manner, it will be appreciated that it is unlikely that a horizontal bar 12 inadvertently will slip out of a slot 24 when it is received and supported in a respective large trough 26.

Likewise, each small trough 28 has a geometrical configuration selected for receiving and supporting a respective horizontal grid rail 30H having a cross-section of a corresponding geometrical configuration.

In the embodiment of FIGS. 1 to 3, each small trough 28 has a generally circular or crescent configuration, for receiving and supporting a corresponding tubular or cylindrical horizontal grid rail 30H. Also, each small trough 28 is formed at a base portion of a respective slot 24. In this manner, it will be appreciated that it is unlikely that a horizontal grid rail 30H inadvertently will slip out of a slot 24 when it is received and supported in a respective small trough 28.

As shown in the embodiment of FIGS. 1 to 3, small trough 28 preferably is formed on an interior side, or that side closest to the wall, of large trough 26. That is, small trough 28 generally is located so that its center is closer to base portion 20 of vertical upright 10 than a center of large trough 26. In this manner, it will be appreciated that a grid rail 30H may be supported in a small trough 28 of a slot 24 at the same time that a horizontal bar 12 is supported in a large trough 26 of the same slot 24. Moreover, it will be appreciated that, when in this configuration, horizontal bar 12 will capture grid rail 30H in small trough 28, and thereby prevent grid 18 from inadvertently coming free from slotted support portion 22 of vertical upright 10.

Each horizontal bar 12 has a size and geometry selected to correspond to the size and geometry of slots 24 and large troughs 26 of each vertical upright 10. For example, in the embodiment of FIGS. 1 to 3, each horizontal bar 12 is generally cylindrical, and preferably is formed by a hollow tube composed of a lightweight but sturdy material, such as steel, aluminum, or plastic.

Referring now to FIG. 3, a shelf bracket 14 of the storage system of FIG. 1 is illustrated in side perspective view. As shown therein, shelf bracket 14 generally has a triangular geometry, and may be made of welded wire to include a horizontal top leg 32, a vertical base leg 34, and an angled support leg 36. Shelf bracket 14 also includes an upwardly projecting front shelf engaging member 38 and an upwardly projecting rear shelf engaging member 40 for securely engaging and supporting a shelf 16. Shelf bracket 14 further includes an upper bar engaging member 42 and a lower bar engaging member 44 for engaging a pair of spaced horizontal bars 12, that are, in turn, carried on the uprights. The bar engaging members of the preferred embodiment will be described in greater detail below. The spacing $S_B$ between upper bar engaging member 42 and lower bar engaging member 44 is selected to correspond to a multiple of the periodic spacing S between slots 24 of vertical upright 10, that is, $S_B$=S, $S_B$=2S, $S_B$=3S, or the like. For example, in the embodiment of FIGS. 1 to 3, $S_B$=2S.

Shelf 16 has a size, configuration and composition selected to correspond to the desired storage application. Shelf 16 preferably is conventional. For example, in the embodiment of FIGS. 1 to 3, shelf 16 may be a METRO PolyErecta or Super Erecta shelf manufactured by Intermetro Industries Corporation, the licensee of the present invention. Although such shelves come in a variety of sizes and compositions, they generally are rectangular in plan form and have a cylindrical or frusto-conical bore or channel located in each corner for receiving a supporting structure. In this manner, it will be appreciated that the shelves of the present embodiment may be used interchangeably with shelves of other known shelving systems, such as "knock-down" type shelving systems. For example, U.S. Pat. Nos. 3,523,508, 3,874,511, and 4,138,953 all relate to shelving systems utilizing a shelf support system including support posts having a circular cross-section and shelves having a bore defining a frusto-conical sleeve at each corner thereof.

In the preferred embodiment, the grid 18 is a mat including intersecting horizontal and vertical grid rails 30H,30V. Grid rails 30 may be composed of any material suitable for supporting hanging brackets, baskets, or the like and in the preferred embodiment are metal wires joined together by welding at points of intersection. Alternatively, grid rails 30 may be composed of plastic, and grid 18 may be formed by molding. As with the upper and lower bar engaging members 42,44, the spacing $S_G$ between horizontal rails 30H is selected to correspond to a multiple of the spacing S between slots 24 of vertical uprights 10, e.g., $S_G$=S, $S_G$=2S, $S_G$=3S, or the like. For example, in the embodiment of FIGS. 1 to 3, $S_G$=S.

Referring again to FIGS. 1 and 3, it will be seen that shelf bracket 14 is constructed of three bracket wires, namely first and second outer bracket wires 46, and a center bracket wire 48 sandwiched therebetween. More specifically, first and second outer bracket wires 46 are bent in parallel in a generally C-shaped configuration, to form two sides of the generally triangular shelf bracket 14, namely, horizontal top leg 32 and angled support leg 36. Center bracket wire 48 then is bent back and forth in a serpentine-like fashion between top leg 32 and angled leg 36, with the apex of each bend being sandwiched between first and second outer bracket wires 46. Center bracket wire 48 is fixed to first and second outer bracket wires 46 by conventional means, such as by welding.

The configuration and number of bends in center bracket wire 48 may vary depending on the application. It will be appreciated that the structural rigidity will increase as the number of bends increases. However, it also will be appreciated that the weight and cost will increase as the number of bends increases. In the embodiment of FIGS. 1 to 3, center bracket wire 48 is bent to form a total of six segments or legs. In this regard, as shown in FIGS. 1 and 3, vertical base leg 34 preferably is formed by bending center bracket wire 48 to form a substantially vertical segment from angled support leg 36 to horizontal top leg 32.

In the present embodiment, front shelf engaging member 38 and rear shelf engaging member 40 may be formed by an extension of center bracket wire 48. For example, as shown in FIG. 3, front shelf engaging member 38 may be formed by bending one end of center bracket wire 48 back upon itself to form an inverted U-shaped loop above top leg 32 proximate to angled leg 36. Likewise, rear shelf engaging member 40 may be formed by bending the other end of center bracket wire 48 back upon itself to form an inverted U-shaped loop above top leg 32 proximate to base leg 34. The height H and width W of each loop generally are selected to correspond to the sizing of the corner bores or channels of shelf 16, and the length L between the loops generally is selected to correspond to the size and configuration of shelf 16, i.e., to the spacing between the corner bores thereof.

Similarly, the upper bar engaging member 42 and the lower bar engaging member 44 may be formed by first and second outer bracket wires 46. For example, in the embodiment of FIGS. 1 to 3, upper bar engaging member 42 is formed by bending one terminal end of each of outer bracket wires 46 (namely, the end of the segment forming horizontal top leg 32) back upon itself to form an inverted U-shaped hook, having its open end facing substantially vertically downward. Lower bar engaging member 44 is formed by bending the other terminal end of each of outer bracket wires 46 (namely, the end of the segment forming angled support leg 36) back upon itself to form a generally inverted L-shaped seat 44*a*.

An L-shaped clip 45 optionally may also be provided at lower bar engaging member 44. Clip 45 may be removably attached or permanently fixed to lower bar engaging member 44. For example, first and second outer bracket wires 46 and clip 45 may be formed of metal, and clip 45 may be welded to the wires. It will be appreciated that, when the shelving system is assembled, the seat 44*a* and clip 45 will abut and embrace horizontal bar 12 and be supported thereon. Moreover, in this configuration, clip 45 effectively will prevent upper bar engaging member 42 from inadvertently lifting vertically and coming free of horizontal bar 12.

In addition, one or more separate tie wires (not shown) may be provided to interconnect the pair of horizontal bars to prevent the spacing therebetween from changing and to further inhibit both bars from disengaging from the vertical uprights.

A preferred method of assembly of the storage system of FIGS. 1 to 3 is described below. From this description, the advantages of the present invention will become readily apparent. First, vertical uprights 10 are mounted to respective wall studs or comparable structure (not shown) by conventional means, such as by screws. Such mounting can be without regard to the width of the shelves. A pair of horizontal bars 12 then are inserted into corresponding slots 24 of vertical uprights 10, so that they are supported at a desired vertical and horizontal location. A pair of shelf brackets 14 then are engaged to the pair of horizontal bars 12 by hooking the respective upper bar engaging members 42 over the top of a first (upper) horizontal bar 12, and rotating the shelf brackets 14 down about the first horizontal bar 12 until the respective lower engaging members 44 seat on a second (lower) horizontal bar 12. In this manner, it will be appreciated that a pair of shelf brackets 14 quickly and reliably may be engaged to, and securely supported on, a pair of horizontal bars 12 at a desired vertical and horizontal location without regard to the particular horizontal spacing of the uprights. Shelf 16 then is securely located, registered, and supported on shelf brackets 14 by inserting front and rear shelf engaging members 38, 40 in respective corner bores of shelf 16. Moreover, it will be appreciated that the horizontal location of shelf 16 readily and repeatedly may be changed merely by horizontally shifting or sliding the shelf and bracket, or shelf bracket/horizontal bar assembly relative to the fixed uprights. Of course, the vertical or horizontal location of the shelf assembly also readily and repeatedly may be changed by removing shelf 16, adjusting the horizontal or vertical location of either horizontal bars 12 or shelf brackets 14, and replacing shelf 16 at the desired location.

Figure 4:
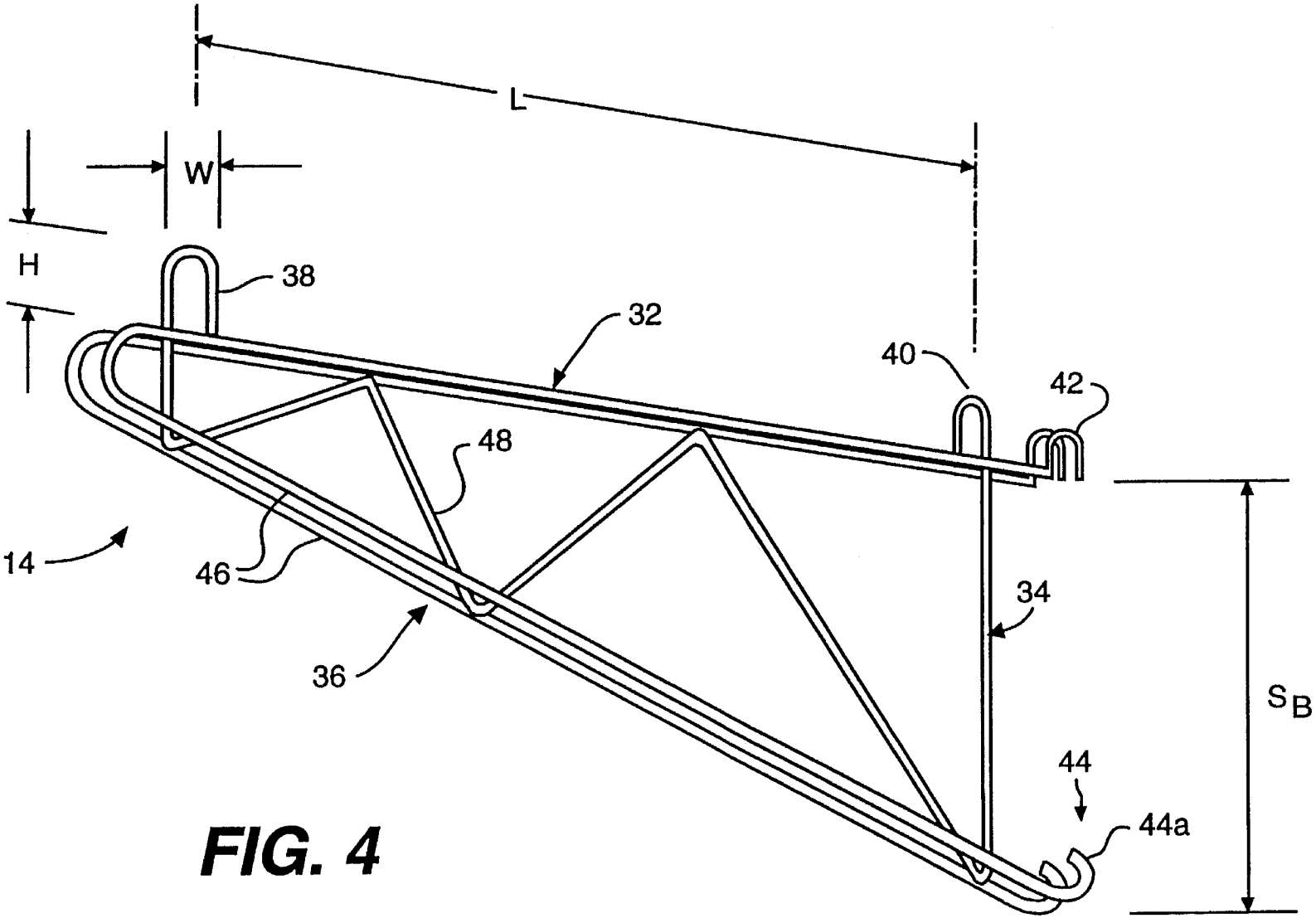
FIG. 4 is a side perspective view of an alternative shelf bracket of the storage system of FIG. 1, illustrating structure for engaging a single horizontal bar, and structure for engaging and supporting a shelf.

FIG. 4 illustrates in side perspective view an alternate embodiment of a shelf bracket 14 of the storage system of FIG. 1. The structure, composition and function of the shelf bracket 14 of FIG. 4 is substantially the same as that in FIG. 3. However, the shelf bracket 14 of FIG. 4 includes a modified lower support engaging member 44. Specifically, lower support engaging member 44 may be formed by bending the terminal end of the segment forming angled support leg 36 down and back upon itself to form a O-shaped stop. It will be appreciated that, when the storage system is assembled, and the upper bar engaging member 42 is hooked over a horizontal bar 12, the shelf bracket 14 will be rotated downward so that the stop of lower support engaging member 44 will be engaged by and supported by either a lower horizontal bar 12, by the wall or other structure to which the storage system is mounted, or both. Thus, it will be appreciated that this embodiment requires only one horizontal bar 12 for each shelf.

In another aspect, the system of FIGS. 1 to 3 may be assembled using the optional grid 18. In this aspect, assembly of the system is substantially the same as above, except that grid 18 is supported on vertical uprights 10 prior to insertion of horizontal bar(s) 12. Specifically, after vertical uprights 10 are mounted on the wall studs, grid 18 is placed on vertical uprights 10 by inserting at least one horizontal grid rail 30H in a corresponding small trough 28 of slots 24. In a preferred orientation, as shown in FIG. 1, grid 18 is arranged so that a vertical grid rail 30V abuts the slotted support portion 22 of at least one vertical upright 10, to provide additional lateral support and rigidity to the storage system. Horizontal bars 12, shelf brackets 14 and shelfs 16 can then further be assembled as described above if desired.

Figure 5:
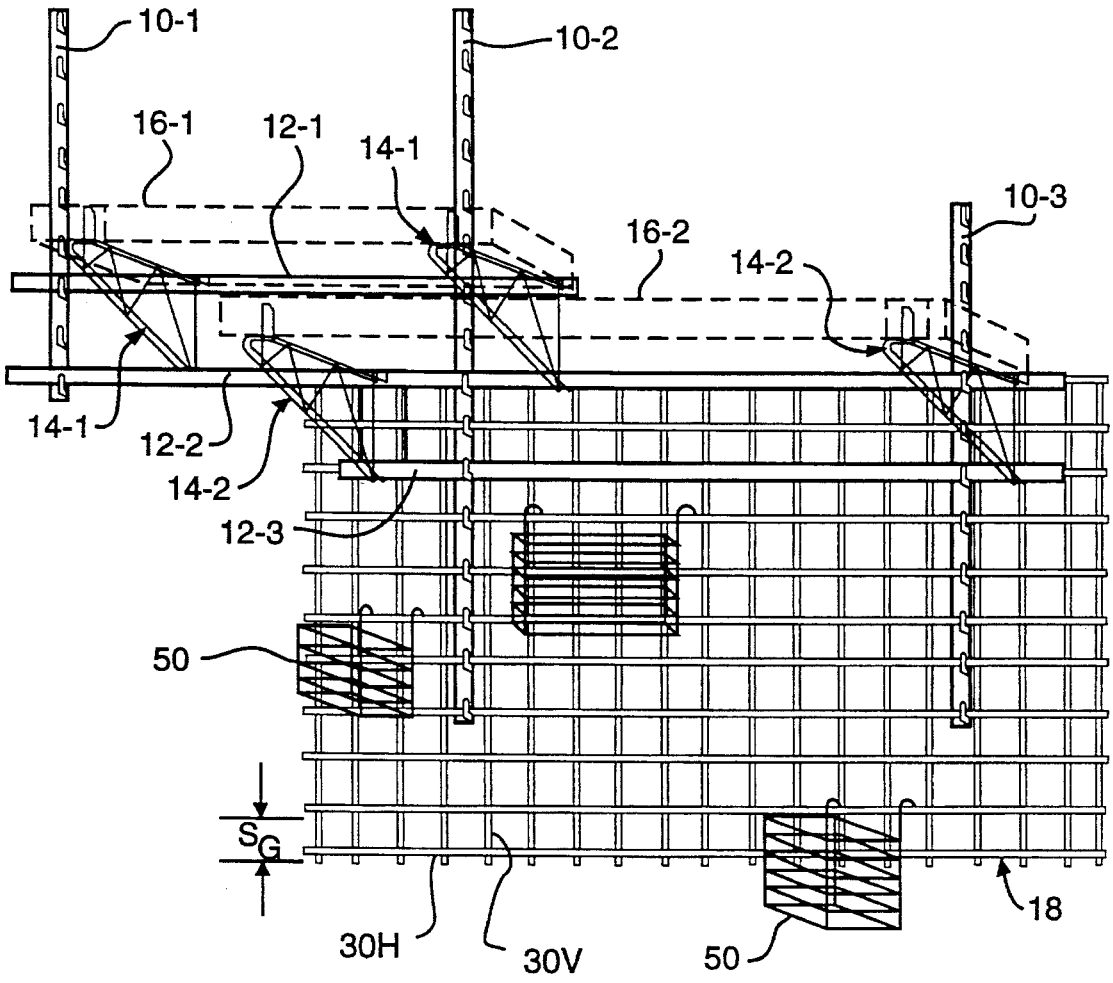
FIG. 5 is a front perspective view showing additional components of the modular wall-mounted storage system according to the present invention, including a plurality of pairs of vertical uprights, a plurality of pairs of horizontal bars, and a vertical grid.

Referring now to FIG. 5, it will be seen how versatile the modular storage system of the present invention is. As shown therein, the system generally includes three vertical uprights 10-1, 10-2 and 10-3 three horizontal bars 12-1, 12-2 and 12-3, two pairs of shelf brackets 14-1 and 14-2 two shelves 16-1 and 16-2 and a grid 18.

The configuration, composition and function of each of the shelving elements of the embodiment of FIG. 5 are substantially the same as the corresponding elements of the embodiment of FIGS. 1 to 3. Accordingly, the details thereof are incorporated herein, and shall not be repeated.

As shown in FIG. 5, vertical uprights 10-1 and 10-2 form a first pair of vertical uprights for supporting horizontal bars 12-1 and 12-2. Likewise, vertical uprights 10-2 and 10-3 form a second pair of vertical uprights for supporting horizontal bars 12-2 and 12-3. Similarly, horizontal bars 12-1 and 12-2 form a first pair of horizontal bars for supporting shelf brackets 14-1 and shelf 16-1, and horizontal bars 12-2 and 12-3 form a second pair of horizontal bars for supporting shelf brackets 14-2 and shelf 16-2. As shown in FIG. 5, the wire-like grid can provide a mount for a wide selection of accessories such as small baskets 50. In this manner, it will be appreciated that the modular system of the present invention may use a plurality of vertical uprights 10 and horizontal bars 12 to provide a wide variety of storage system designs.

From the description provided above, it will be appreciated that the present invention provides a modular wall-mounted storage system that can readily be mounted through vertical uprights carried on existing wall studs. Nevertheless, those uprights can support a wide variety of shelf members without regard to the width of the shelves or without such width being coordinated to horizontal spacing between underlying supporting studs.

Although specific embodiments of the invention have been described above in detail, it will be understood that this description is merely for purposes of understanding the invention. Modifications of, and equivalents to, the preferred embodiments described herein may be made by those skilled in the art without departing from the scope of the present invention, which is set forth in the following claims.

What is claimed is:

1. A modular wall-mounted storage system for supporting at least one storage structure in generally horizontal relation, said system comprising:

a first horizontal bar;

a bracket, including means for supporting a storage structure and means for engaging said first horizontal bar; and a pair of slotted supports, each slotted support including a plurality of slots for receiving and supporting said first horizontal bar at a variety of spaced vertical locations, wherein said first horizontal bar is supportable on said pair of slotted supports at a variety of vertical and horizontal locations relative to said pair of slotted supports; said bracket is engageable on said first horizontal bar; and a storage structure is supportable on said supporting means of said bracket.

2. The storage system of claim 1, wherein each of said slotted supports includes a plurality of slots, each slot having a trough for receiving and supporting said first horizontal bar.

3. The storage system of claim 2, wherein said first horizontal bar is tubular, and each trough is partially circular.

4. The storage system of claim 1, further comprising:

a vertical grid including a horizontal grid rail, wherein each of said slotted supports includes means for receiving and supporting said first horizontal bar and means for receiving and supporting said horizontal grid rail.

5. The storage system of claim 4, wherein said vertical grid is a wire mat.

6. The storage system of claim 4, wherein each one of said pair of slotted supports includes a plurality of slots, each slot having a first trough for receiving and supporting said first horizontal bar and a second trough for receiving and supporting a grid rail.

7. The storage system of claim 6, wherein said first horizontal bar is tubular, each first trough has a partially circular base portion for receiving said horizontal bar, said horizontal grid rail is cylindrical, and each second trough has a partially circular base portion for receiving said horizontal grid rail.

8. The storage system of claim 7, wherein for each slot said second trough is located adjacent said first trough.

9. The storage system of claim 8, wherein for each slot said first trough has a base portion and said second trough is formed at said base portion.

10. The storage system of claim 9, wherein for each slot said first trough and said second trough are formed such that, when said horizontal grid rail is received and supported in said second trough of said slot and said first horizontal bar is received and supported in said first trough of said slot, said first horizontal bar captures said horizontal grid rail in said second trough.

11. The storage system of claim 1, further comprising a vertical upright having a base and a web portion, at least one of said slotted supports being formed in said web portion.

12. The storage system of claim 11, wherein each of said slotted supports includes a plurality of slots periodically formed along a vertical length of said vertical upright.

13. The storage system of claim 12, further comprising a second horizontal bar supportable on said pair of slotted supports at a variety of vertical and horizontal locations relative to said pair of slotted supports, wherein said bracket is engageable with each of said first horizontal bar and said second horizontal bar at a spacing corresponding to a multiple of the periodic spacing of said plurality of slots.

14. The storage system of claim 12, said vertical grid further comprising a second horizontal grid rail, wherein a spacing of said first horizontal grid rail and said second horizontal grid rail corresponds to a multiple of the periodic spacing of said slots.

15. The storage system of claim 1, wherein said first horizontal bar is tubular.

16. The storage system of claim 1, further comprising a pair of vertical uprights each having a base and a web portion, said slotted supports being formed in respective web portions of said vertical uprights.

17. A modular wall mounted system for supporting articles, said system comprising:

at least one pair of uprights each being configured to be mounted on a generally vertically extending wall, each said upright including slotted support means, with said support means of each of said uprights being positionable in general horizontal registry with said support means of the other of said uprights when said uprights are mounted on the wall;

at least two horizontal bars each mountable in said slotted support means of said uprights in generally mutually parallel, vertically spaced relation, at a variety of vertical and horizontal locations relative to the slotted support means; and at least one article supporting bracket including means for engaging each one of said bars and cantilever means projecting from said engaging means away from the wall for supporting at least one article.

18. The storage system of claim 1, further comprising a second horizontal bar, wherein each of said slotted supports includes means for receiving and supporting said first horizontal bar and means for receiving and supporting said second horizontal bar.

19. The storage system of claim 18, wherein each one of said pair of slotted supports includes a plurality of slots, each slot having a first trough for receiving and supporting said first horizontal bar and a second trough for receiving and supporting said second horizontal bar.

20. The storage system of claim 19, wherein said first horizontal bar has a first radius and said second horizontal bar has a second radius, different from said first radius, and a radius of a circular base of said first trough corresponds to the radius of said first horizontal bar and a radius of a circular base of said second trough corresponds to the radius of said second horizontal bar.

21. The storage system of claim 20, wherein for each slot, said second trough is located adjacent said first trough.

22. The storage system of claim 20, wherein for each slot said first trough and said second trough are formed such that, when said second horizontal bar is received and supported in said second trough of the slot, and said first horizontal bar is received and supported in said first trough of the slot, said first horizontal bar captures said second horizontal bar in said second trough.

* * * * *